US007402069B2

(12) United States Patent
Shigeta et al.

(10) Patent No.: US 7,402,069 B2
(45) Date of Patent: Jul. 22, 2008

(54) CONNECTOR

(75) Inventors: Yoshinori Shigeta, Shizuoka (JP); Akihiro Tsuruta, Shizuoka (JP); Hiromasa Kubota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/590,901

(22) Filed: Nov. 1, 2006

(65) Prior Publication Data

US 2007/0105420 A1 May 10, 2007

(30) Foreign Application Priority Data

Nov. 4, 2005 (JP) ..... 2005-320496

(51) Int. Cl.
*H01R 13/627* (2006.01)

(52) U.S. Cl. ..... 439/352; 439/489

(58) Field of Classification Search ..... 439/352, 439/357, 358, 488, 489
See application file for complete search history.

(56) References Cited

U.S. PATENT DOCUMENTS 5,807,130 A * 9/1998 Miller et al. ..... 439/352
6,077,101 A * 6/2000 Garretson et al. ..... 439/352
6,354,860 B1 * 3/2002 Miller et al. ..... 439/352
6,491,542 B1 * 12/2002 Zerebilov ..... 439/489
6,908,329 B2 * 6/2005 Kozono et al. ..... 439/352
7,252,530 B2 * 8/2007 Shamoto ..... 439/352
2007/0054535 A1 * 3/2007 Hall et al. ..... 439/352

FOREIGN PATENT DOCUMENTS

JP 2004-220970 8/2004

* cited by examiner

*Primary Examiner*—Hien D. Vu
(74) *Attorney, Agent, or Firm*—Kratz, Quintos & Hanson, LLP

(57) ABSTRACT

A connector housing includes a housing main body and a tubular shroud. Terminal receiving chambers are mounted on the housing main body. A male connector housing is inserted into the shroud. The male connector housing receives male terminals to be fitted to female terminals received in the terminal receiving chambers. A notched groove is formed on the shroud in a length direction of the female terminals. A half-fit detecting member receives a female connector housing and includes a pair of correcting ribs. A pair of abutting walls facing each other is mounted on both sides of the notched groove. The pair of correcting ribs abuts on the pair of abutting walls to prevent a width of the notched groove to be reduced.

4 Claims, 9 Drawing Sheets

CONNECTOR

CROSS REFERENCE TO RELATED APPLICATIONS

This application is based on Japanese Patent Application No. 2005-320496, the contents of which are hereby incorporated by reference.

BACKGROUND OF THE INVENTION

1. Field of the Invention

The present invention relates to a connector, in particular, to a connector including a connector housing having terminal receiving chambers and a housing cover to receive the connector housing.

2. Description of the Related Art

As a conventional connector, Japanese published patent application No. 2004-220970 discloses a half-fit preventing connector shown in FIGS. 9 and 10. The half-fit preventing connector consists of a female connector housing 20 having terminal receiving chambers and a half-fit detecting member 30 as a housing cover receiving the female connector housing 20.

Unless the female connector housing 20 and a mating male housing (not shown) are connected completely, the half-fit detecting member 30 prevents the female connector housing 20 from sliding from a initial position where the female connector housing 20 is projected from a top end opening of the half-fit detecting member 30 to a fit-detecting position where the whole female connector housing 20 is received in the half-fit detecting member 30. Whether the female connector housing 20 is completely connected to the male connector housing or not can be judged by whether the female connector housing 20 is positioned at the initial position or the fit-detecting position.

The female connector housing 20 includes a substantially cylindrical housing main body 21. Terminal receiving chambers 211 for receiving the female terminals are formed in the housing main body 21. A front holder 26 is attached to the housing main body 21 via an O-ring 25 from a top end of the female terminal in a length direction Y1 thereof.

Two pairs of guiding projections 27 are projected from an outer wall at a rear end of the housing main body 21 in the length direction Y1. Guide receivers 35, 35 corresponding to guiding projections 27, 27 are formed on an inner peripheral wall of the half-fit detecting member 30. Because the guiding projections 27, 27 are inserted into the guiding receivers 35, 35, the sliding position between the female connector housing 20 and the half-fit detecting member 30 is prevented from shifting, and the female connector housing 20 slides smoothly.

However, according to the conventional connector, due to an insertion of the male connector housing, the guiding projection 27 is only formed at an outer sidewall back end from a deepest part F where a top end of the connector housing is positioned when the connector is connected to mating connector. Therefore, when the female connector housing 20 is assembled with the half-fit detecting member 30, a rattle is generated at the top end of the female connector housing 20. Thus, fitting feeling is reduced, and the female connector housing 20 has a structure that a prying or a reverse-engagement is generated easily when the female connector housing 20 is connected to the mating connector.

Accordingly, an object of the present invention is to provide a connector that prevents a rattle between a connector housing and a housing cover, and increases connecting reliability and assembling ability.

SUMMARY OF THE INVENTION

In order to attain the object, according to the present invention, there is provided a connector including:

a connector housing including a housing main body having terminal receiving chambers for receiving terminals, and a tubular shroud on which a notched groove is formed in a length direction of the terminal; and a housing cover receiving the connector housing and having a deformation-preventing member abutting on the shroud for preventing the notched groove from being deformed in a direction of reducing a groove width thereof.

Preferably, a pair of abutting walls facing each other is formed on both sides of the notched groove, and the deformation-preventing member is a pair of abutting pieces respectively abutting on the pair of abutting walls.

Preferably, tapers are formed at rear ends of the pair of abutting walls in the length direction so as to narrow a distance therebetween toward front ends thereof.

Preferably, a fitting groove is formed on one of an outer sidewall of the shroud and an inner sidewall of the housing cover, and a fitting projection for fitting to the fitting groove is formed on the other.

Preferably, a locking member is mounted on each of the shroud and the connector cover in the length direction to lock each other.

Preferably, the shroud receives the housing main body, and the front end of the shroud in the length direction is arranged at a forward side of the top end of the housing main body in the length direction.

These and other objects, features, and advantages of the present invention will become more apparent upon reading of the following detailed description along with the accompanied drawings.

DETAILED DESCRIPTION OF THE PREFERRED EMBODIMENTS

Figure 1:
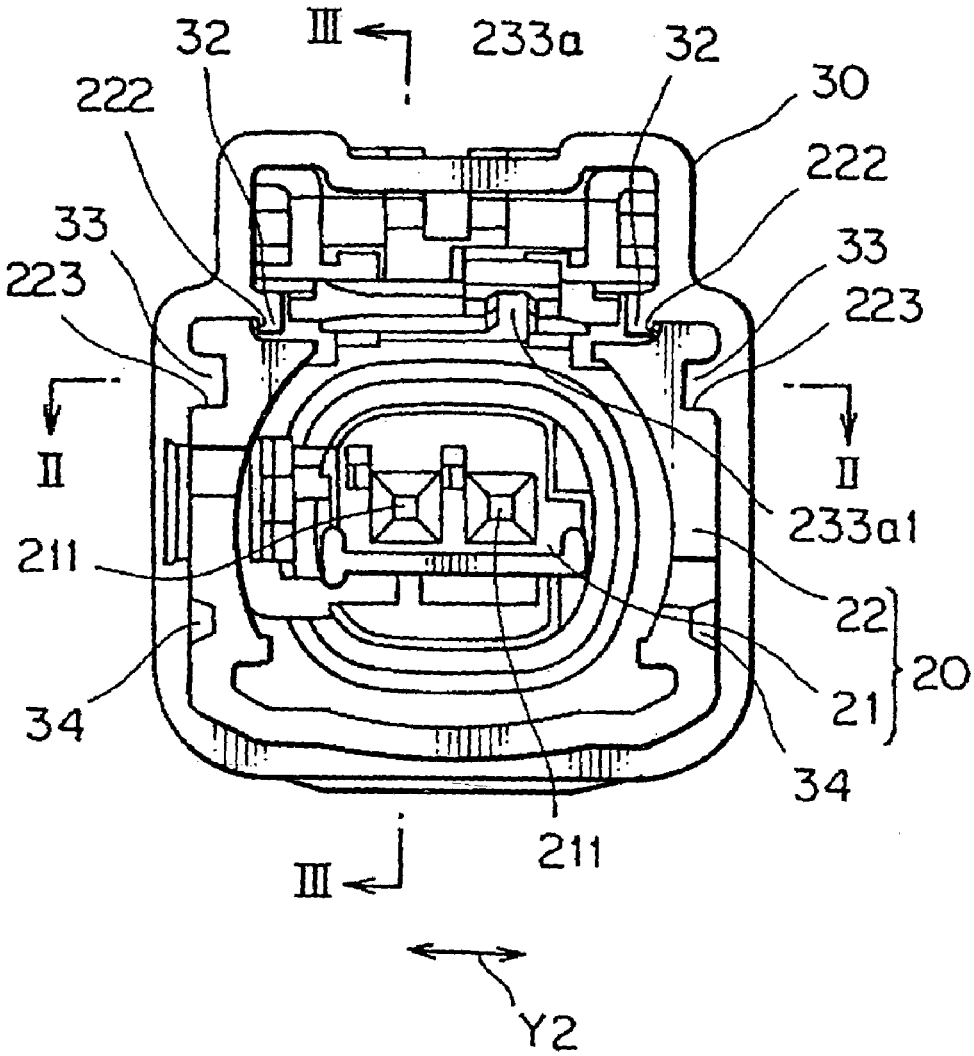
FIG. 1 is a front view showing an embodiment of a connector according to the present invention.

An embodiment of a connector according to the present invention will be described with reference to Figures.

As shown in FIG. 2, the connector includes a female connector housing 20 having terminal receiving chambers 211 for receiving female terminals (not shown), and a half-fit detecting member 30 (housing cover) for receiving the female connector housing 20. The female connector housing 20 includes a substantially box shaped housing main body 21. The terminal receiving chambers 211 are formed on the housing main body 21.

The female connector housing 20 further includes a tubular shroud 22 into which a male connector housing 40 is inserted. The male connector housing 40 receives male terminals (not shown) for fitting to the female terminals received in the terminal receiving chambers 211. A top end of the shroud 22 in the length direction Y1 of the female terminal is opened. A rear end of the shroud 22 in the length direction Y1 is closed by a rear end wall 23*a*.

The housing main body 21 and the shroud 22 are integrally formed in a manner that an inside of the shroud 22 receives the housing main body 21 and a rear end of the housing main body 21 is connected to the rear end wall 23*a* of the shroud 22. A terminal inserting projection 23*a*1 is formed on the rear end wall 23*a*. An insertion hole communicating to the terminal receiving chambers 211 is formed on the terminal inserting projection 23*a*1.

Figure 5:
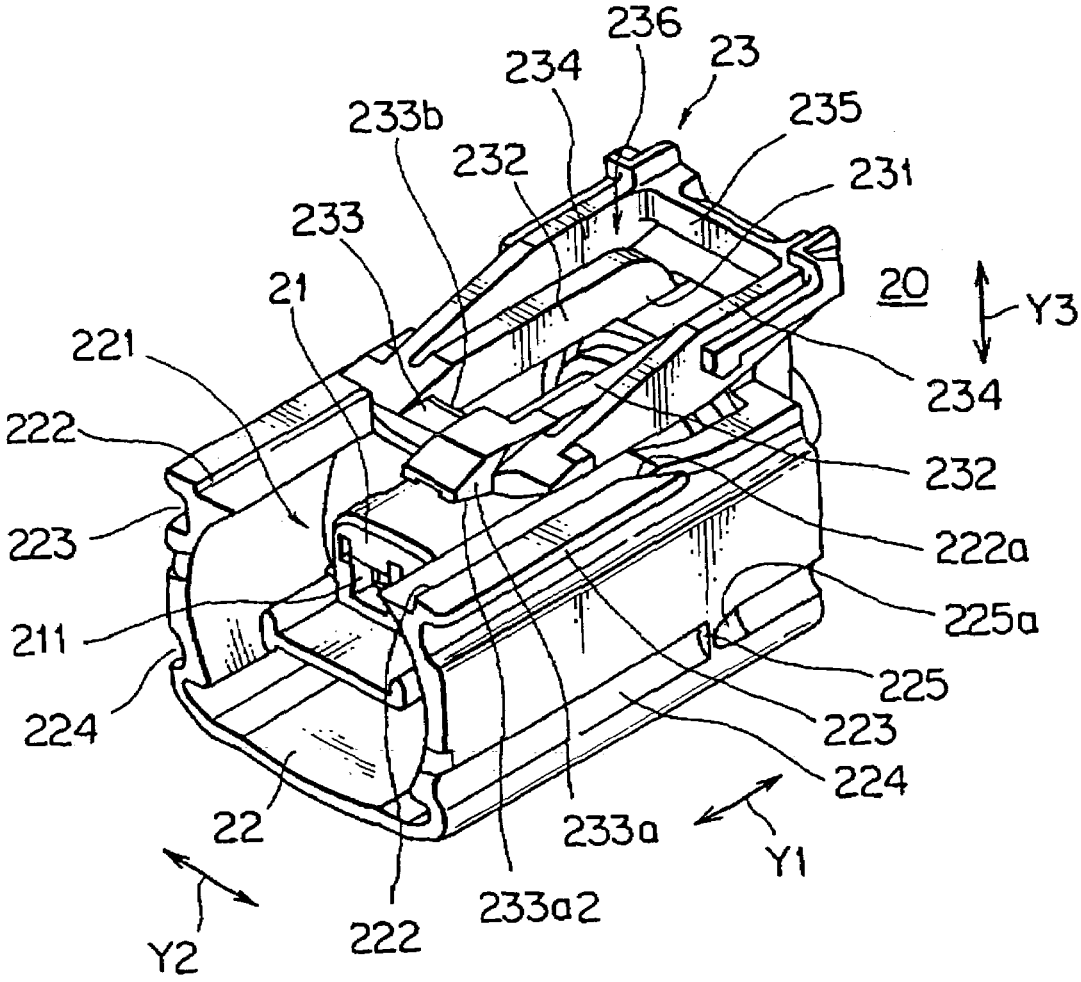
FIG. 5 is a perspective view showing a female connector housing 20 composing the connector of FIG. 1.
Figure 6:
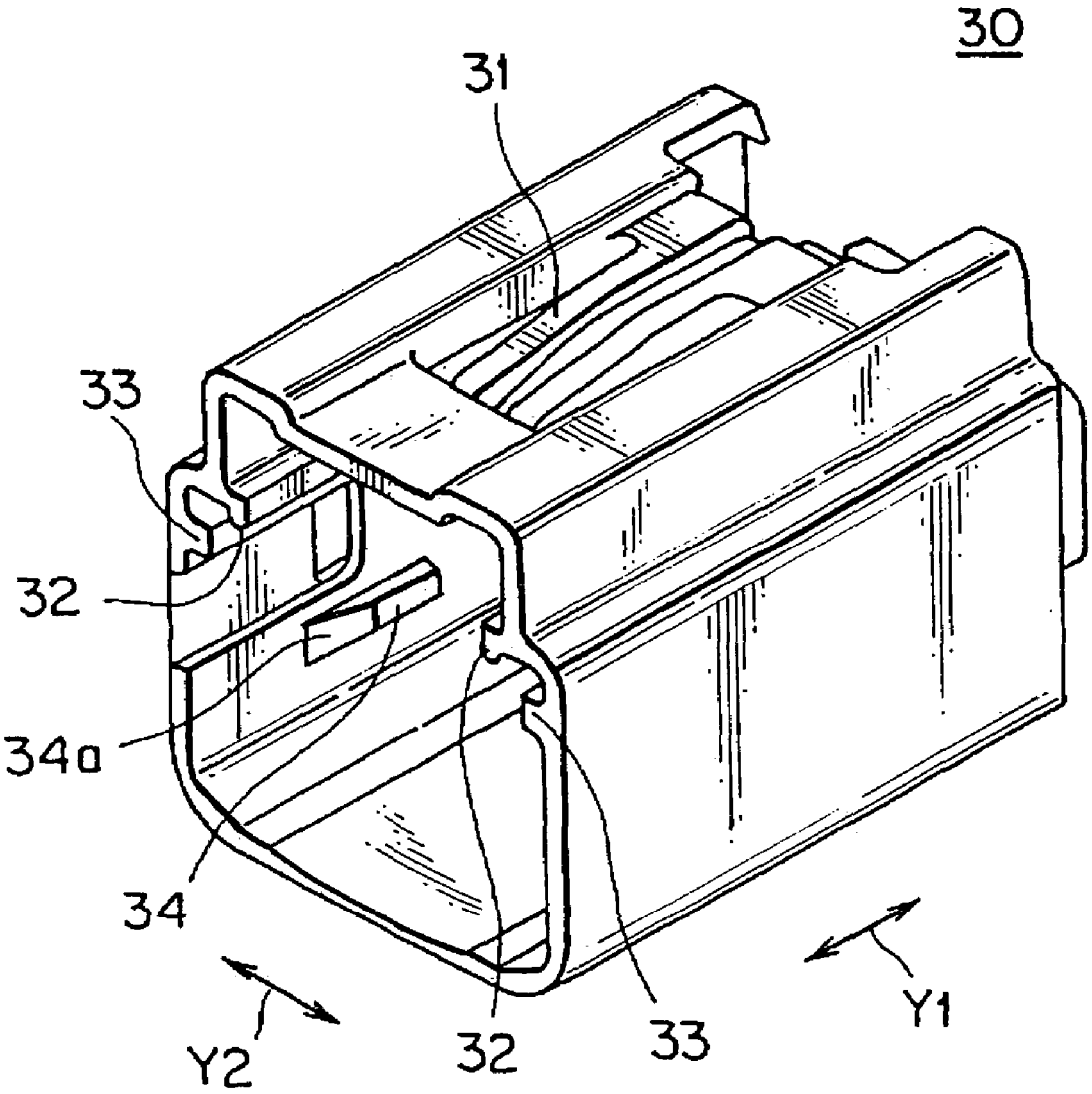
FIG. 6 is a perspective view showing a half-fit detecting member 30 composing the connector of FIG. 1.

The top end of the shroud 22 in the length direction Y1 is arranged at the forward of the top end of the housing main body 21 in the length direction Y1. Namely, the whole housing main body 21 is received in the shroud 22. As shown in FIG. 5, a notched groove 221 is formed on the shroud 22. A locking projection 41 (FIG. 2) extended on an outer sidewall of the male connector housing 40 from the top end to the rear end thereof in the length direction Y1 is exposed from the notched groove.

Figures 2A, 2B:
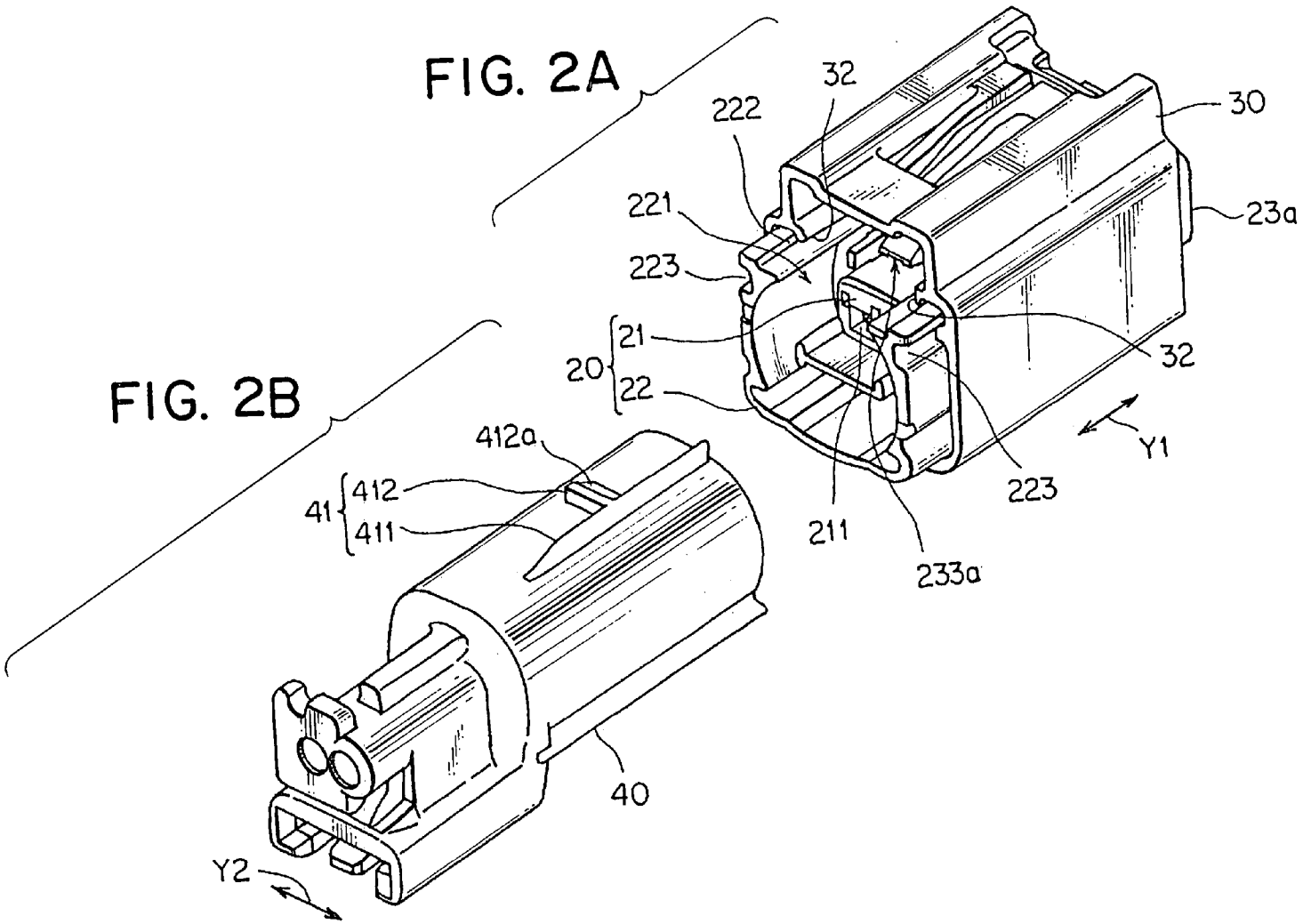
FIG. 2A is a perspective view showing the connector of FIG. 1.
FIG. 2B is a perspective view showing a male connector housing 40 connected to the connector of FIG. 1.

As shown in FIG. 2B, a locking projection 41 of the male connector housing 40 is composed of a linear projection 411 extended along the length direction Y1, and a projecting claw 412 disposed at substantially the center of the linear projection 411 in the length direction Y1. The projecting claw 412 includes a taper 412*a* toward the rear thereof in the length direction Y1.

As shown in FIG. 5, a resilient locking arm 23 is integrally formed on the female connector housing 20. The resilient locking arm 23 locks the locking projection 41 exposed from the notched groove 221. The resilient locking arm 23 includes a pair of arms 232 extended toward the top end from a pair of pillars 231 (FIG. 4) extended from a rear end of the shroud 22. The pair of arms 232 is spaced each other in a groove width direction Y2 of the notched groove 221.

The resilient locking arm 23 is composed of a connecting part connecting the top ends of the pair of arms 232, a pair of arms 234 extending backward from the top ends of the arms 232 to the pillars 231, a connecting part 235 connecting rear ends of the pair of arms 234, and a locking hole 236 surrounded by the pairs of arms 232, 234 and the connecting parts 233, 235. The connecting parts 233, 235 of the resilient locking arm 23 can be lifted up and down about the pillars 231.

A projecting claw 233*a* is formed on a position corresponding to the linear projection 411 of the male connector housing 40 at the top end of the connecting part 233. An insertion groove 233*a*1 (FIG. 1) is formed along the length direction Y1 on a wall at the notched groove 221 side of the projecting claw 233*a*. The linear projection 411 is inserted into the insertion groove 233*a*1. A taper 233*a*2 toward the far side of the notched groove 221 is formed on the notched groove 221 side of the projecting claw 233*a*.

Thus, when the male connector housing 40 is inserted into the shroud 22 of the female connector housing 20, the linear projection 411 of the male connector housing 40 is smoothly inserted into the insertion groove 233*a*1 without any catch by the projecting claw 233*a*. As the projecting claw 233*a* extends toward the top end in the length direction Y1, a thickness of the projecting claw 233*a* decreases.

Steps are provided at both sidewalls of the notched groove 221 of the shroud 22. The steps make the abutting walls extending from the top end to the intermediate part in the length direction Y1. A taper 222*a* is formed at the rear end of the pair of abutting walls 222 in the length direction Y1. A width of the taper 222*a* decreases as the taper 222*a* extends toward the top end.

A pair of fitting grooves 223, a pair of grooves 224 both extending from the top end to the rear end of the shroud 22 in the length direction Y1, and a pair of locking projections 225 disposed respectively in the groove 224 are formed at both sidewalls of the notched groove 221 of the shroud 22. A taper 225*a* is formed at the rear end of the locking projection 225. A height of the taper 225*a* decreases as the taper 225*a* extends toward the rear end.

Figure 4:
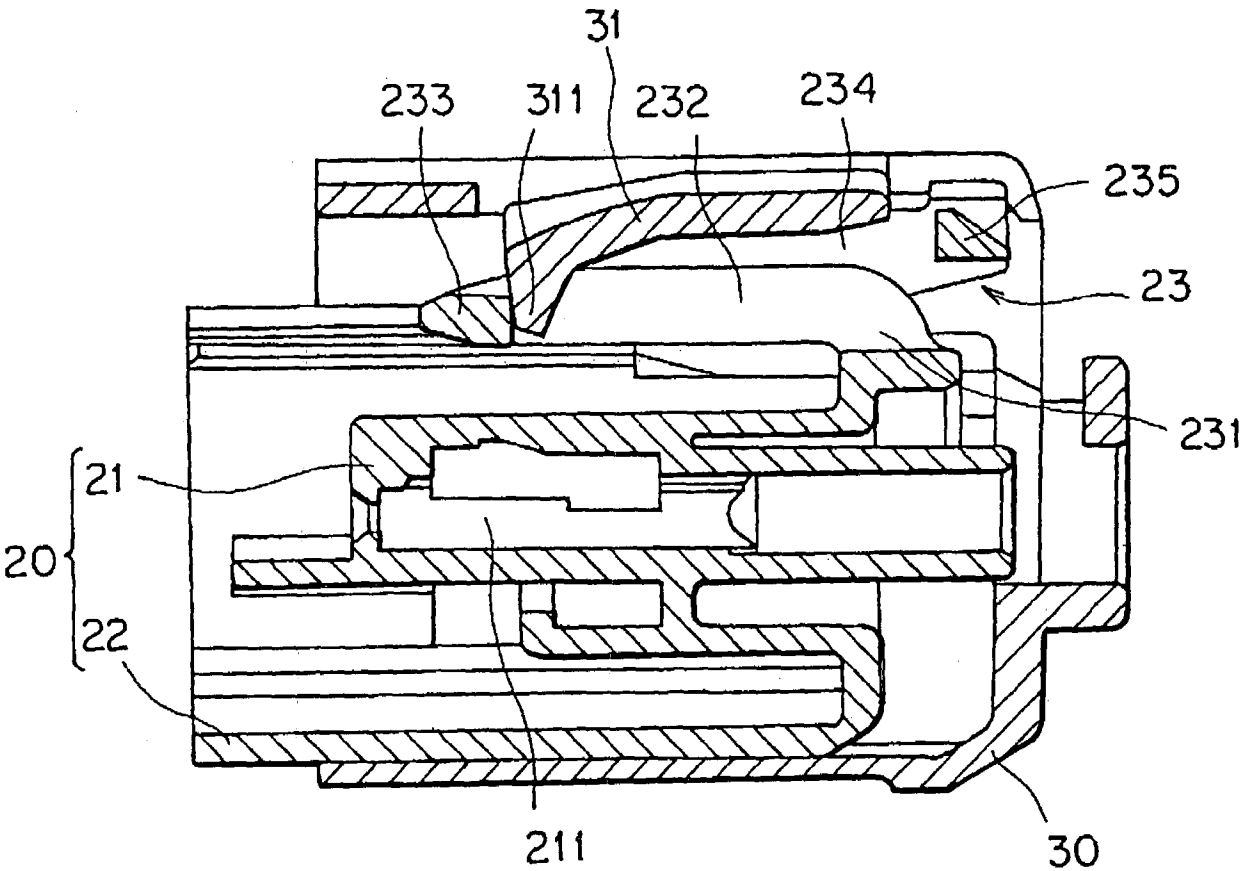
FIG. 4 is a sectional view taken on line III-III in FIG. 1.

Next, a structure of the half-fit detecting member 30 will be explained. As shown in FIG. 4, a resilient locking arm 31 is mounted on a wall facing the resilient locking arm 23 of the half-fit detecting member 30. The resilient locking arm 31 can be bent in the same direction Y3 as the resilient locking arm 23. As shown in FIG. 4, a locking claw 311 is formed on the resilient locking arm 31. The locking claw 311 projects toward the notched groove 221.

A pair of deformation-preventing ribs 32, a pair of fitting projections 33, and a pair of locking projections 34 are mounted on an inner sidewall of the half-fit detecting member 30. Each deformation-preventing rib 32 has an L-shape in a front view, abuts on the pair of abutting walls 222, and prevents the shroud 22 from being deformed in a direction of reducing the groove width of the notched groove 221. The pair of fitting projections 33 is slidably fitted to the fitting grooves 223 in the length direction Y1. The locking projections 34 lock the locking projections 225. A taper 34*a* is formed on the top end of the locking groove 34. A height of the taper 34*a* decreases as the taper 34*a* extends toward the top end.

Next, an insertion of the female connector housing 20 into the half-fit detecting member 30 will be explained. First, a rear end of the female connector housing 20 is inserted into the opening at the top end of the half-fit detecting member 30. Then, by shifting the female connector housing 20 toward a rear end in the length direction Y1, the top end of the fitting projection 33 reaches the rear end opening and is fitted to the fitting groove 223.

At this time, the pair of deformation-preventing ribs 32 is inserted into between the pair of tapers 222*a*. When the shroud is about to be deformed in a direction of reducing the groove width of the notched groove 221, the pair of deformation-preventing ribs 32 abuts on the tapers 222*a*. When the female connector housing 20 is further moved toward the rear end in the length direction Y, the pair of deformation-preventing ribs 32 gradually enlarge the groove width of the notched groove 221 along the tapers 222*a*. Thus, the pair of deformation-preventing ribs 32 abuts on a pair of abutting walls 222 and deforms to be a normal groove width.

Then, in this case, the top ends of the locking projections 34 also reaches the rear end opening of the grooves 224, and are inserted into the grooves 224. When the female connector housing 20 is further moved toward the rear end in the length direction Y1, the locking projections 34 reaches the locking projections 225, and both sidewalls of the shroud 22 are deformed in a direction of approaching to each other along the tapers 34*a*, 225*a*.

Then, as shown in FIGS. 2 and 4, when the female connector housing 20 is inserted to an initial position where the top end of the shroud 22 projects from the top end of the half-fit detecting member 30, the locking projections 34 reach the grooves 224 disposed nearer at the top end side than the locking projection 225 so that the deformation at both sidewalls of the shroud 22 is restored. Thus, the locking projection 225 and the locking projection 34 are arranged in the length direction Y1 and lock with each other. Therefore, when the female connector housing 20 is pulled toward the top end of the length direction Y1, the female connector housing 20 does not move from the initial position. Accordingly, the locking projections 225, 34 are the locking member in claims.

When the female connector housing 20 is at the initial position, as shown in FIG. 4, the locking claw 311 of the resilient locking arm 31 and a connecting part 233 are arranged in the longitudinal direction Y1 and lock with each other, so that when the female connector housing 20 is pulled toward the back side of the length direction Y1, the female connector housing 20 does not move from the initial position. Accordingly, the resilient locking arm 31 and the connecting part 233 are the locking member in claims.

According to the connector, a pair of abutting walls 222 is mounted on the both sides of the notched groove 221 of the shroud 22 facing each other. The deformation-preventing ribs 32 abut on the pair of abutting walls 222 so that the groove width of the notched groove 221 is prevented from being reduced. Therefore, the abutting walls 222 of the shroud 22 press the deformation-preventing ribs 32 of the half-fit detecting member 30 for reducing the groove width of the notched groove 221, and the deformation-preventing ribs 32 of the half-fit detecting member 30 press the shroud 22 for expanding the groove width of the notched groove 221.

Therefore, a force between the abutting walls 222 of the shroud 22 and the deformation-preventing ribs 32 of the half-fit detecting member 30 prevents a rattle between the female connector housing 20 and the half-fit detecting member 30. Further, because the deformation-preventing ribs 32 prevents the shroud 22 from being deformed in a direction of reducing the groove width of the notched groove 221, the shroud 22 and the male housing 40 to be inserted into the shroud 22 are prevented from interfering with each other. Therefore, connecting reliability and the assembling workability are improved.

Further, according to the connector, the taper 222*a*, of which width of the taper 222*a* decreases as the taper 222*a* extends toward the top end, is mounted on the rear end in the length direction Y1 of the pair of abutting walls 222. Thus, when the rear end of the female connector housing 20 is inserted from the top end opening of the half-fit detecting member 30, the taper 222*a* guides the deformation-preventing ribs 32 of the half-fit detecting member 30 to the abutting walls 222, so that the pair of the deformation-preventing ribs 32 are surely inserted into between the pair of abutting walls 222.

Further, according to the connector, the fitting groove 223 is formed at the outer sidewall of the shroud 22, and a fitting projection 33 for fitting with the fitting groove 223 is mounted on an inner sidewall of the half-fit detecting member 30. Therefore, when the fitting groove 223 and the fitting projection 33 are fitted with each other, a rattle in a direction Y perpendicular to the length direction Y1 and the groove width direction Y2 is prevented.

Further, according to the connector, a locking projection 225 and a locking projection 34 which are arranged in the length direction Y1 and lock each other are mounted on each of the shroud 22 and the half-fit detecting member 30. Further, the connecting part 233 and a locking claw 311 which are arranged in the length direction Y1 and lock each other are formed on each of the shroud 22 and the half-fit detecting member 30. Accordingly, when the locking projection 225 and the locking projection 34 lock together and the connecting part and the locking claw lock together, the rattle in the length direction Y1 is prevented.

Figure 3:
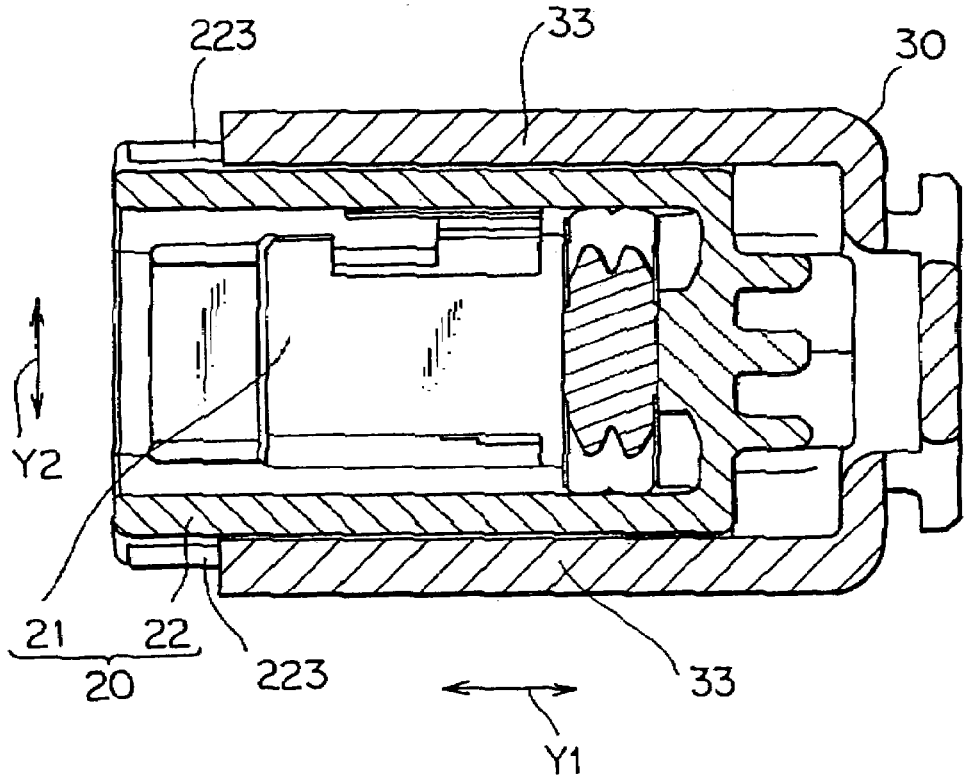
FIG. 3 is a sectional view taken on line II-II in FIG. 1.

Further, according to the connector, the shroud 22 receives the housing main body 21 and disposed at the topper end side than the top end of the housing main body 21 in the length direction Y1. Therefore, as shown in FIG. 3, a contact area between the half-fit detecting member 30 and the female connector housing 20 is increased, and the rattle between the female connector housing 20 and the half-fit detecting member 30 in the length direction Y1 is prevented.

Next, operations of each part when the female connector housing 20 and the male connector housing 40 are fitted to each other will be explained. When the male connector housing 40 is inserted into the shroud 22, and the top end of the linear projection 411 reaches the top end of the projecting claw 233*a*, the linear projection 411 is inserted into the insertion groove 233*a*1 formed on the projecting claw 233*a*, so that the male connector housing 40 is more smoothly inserted in the length direction Y1.

Figure 7A:
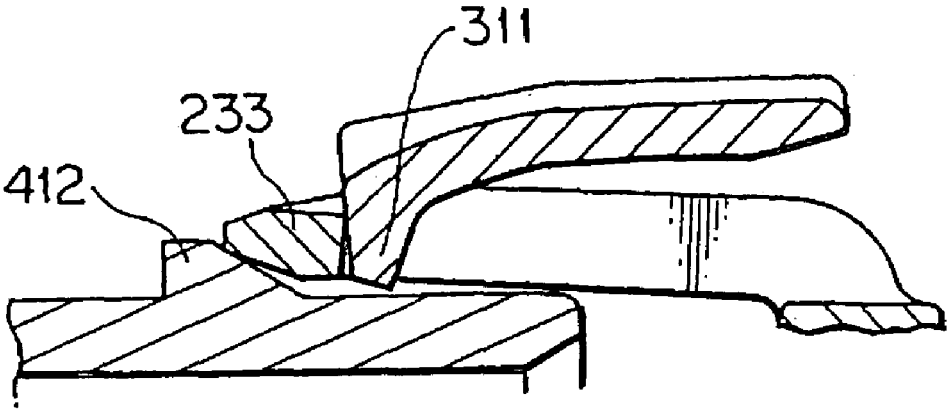
FIG. 7A is a partially sectional view showing the female connector housing 20 and the male connector housing 40 in a half-fitting state.

As shown in FIG. 7A, when the top end of the projecting claw 412 reaches the projecting claw 233*a*, the projecting claw 412 gradually pushes up the connecting part 233 of the resilient locking arm 23 along the tapers 412*a*, 233*a*2, so that the resilient locking arm 23 and the connecting part 233 lock together more strongly. In such a half fitting state, the female connector housing 20 does not move from the initial position.

Figure 7B:
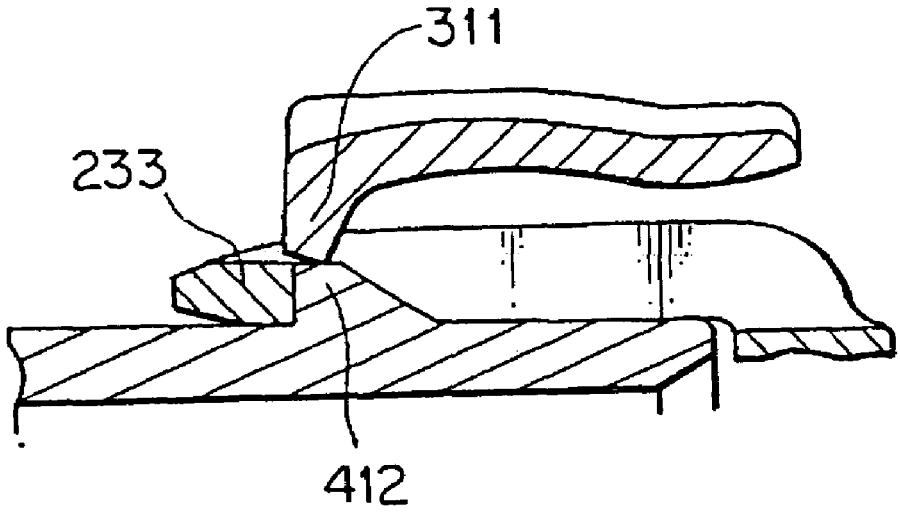
FIG. 7B is a partially sectional view showing the female connector housing 20 and the male connector housing 40 in a fully fitting state.

Further, the male connector housing 40 is inserted, and the rear end of the projecting claw 412 in the length direction Y1 reaches the locking claw 311, the projecting claw 412 pushes up the locking claw 311. Then, as shown in FIG. 7B, the top end of the projecting claw 412 reaches the rear end of the connecting part 233, namely, when the projecting claw 412 is inserted into the locking hole 236, the resilient locking arm 23 is restored to be a full fitting state that the resilient locking arm 23 and the projecting claw 412 lock together. At the full fitting state, the projecting claw 412 pushes up the locking claw 311 of the resilient locking arm 31, and releases the lock between the resilient locking arm 31 and the connecting part 233. Thus, the female connector housing 20 can be inserted into the rear side of the half-fit detecting member 30.

Incidentally, in the embodiment described above, the half-fit detecting member 30 for detecting the half fitting of the female connector housing 20 and the male connector housing 40 is used as the housing cover. However, any housing cover which receives the female connector housing 20 may be used.

Further, in the embodiment described above, the locking projection 41 of the male connector housing 40 is exposed from the notched groove 221. However, if the notched groove 221 is mounted on the tubular shroud 22 along the length direction Y1, the locking projection 41 of the male connector housing 40 may not exposed from the notched groove 221.

Further, in the embodiment described above, the fitting groove 223 is mounted on the outer sidewall of the shroud 22 along the length direction Y1, and the fitting projection 33 for fitting to the fitting groove 223 is mounted on the inner sidewall of the half-fit detecting member 30. However, the present invention is not limited to this. Inversely, the fitting groove may be formed on the inner sidewall of the half-fit detecting member 30 along the length direction Y1, and the fitting projection for fitting to the fitting groove may be formed on the outer sidewall of the shroud 22.

Figure 8A:
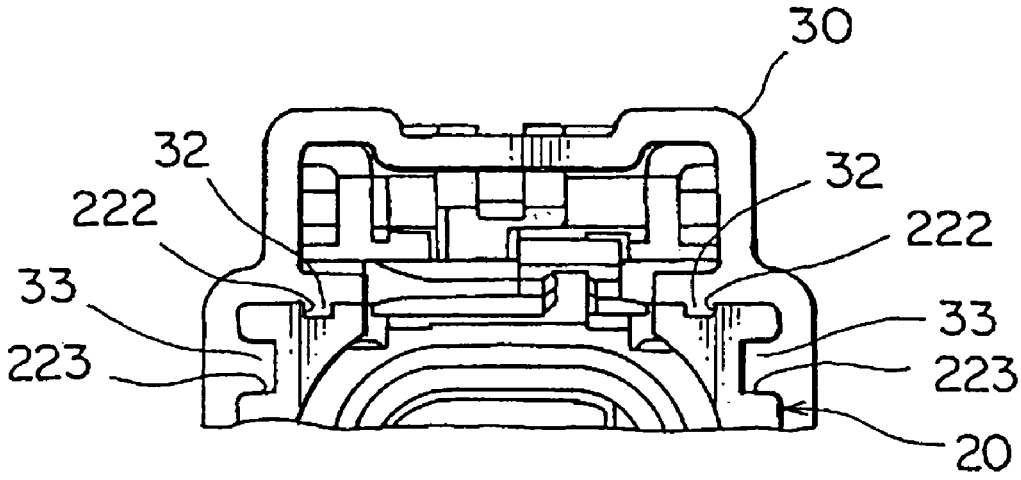
FIGS. 8A and 8B are partially front views showing another embodiment of the connector according to the present invention.
Figure 8B:
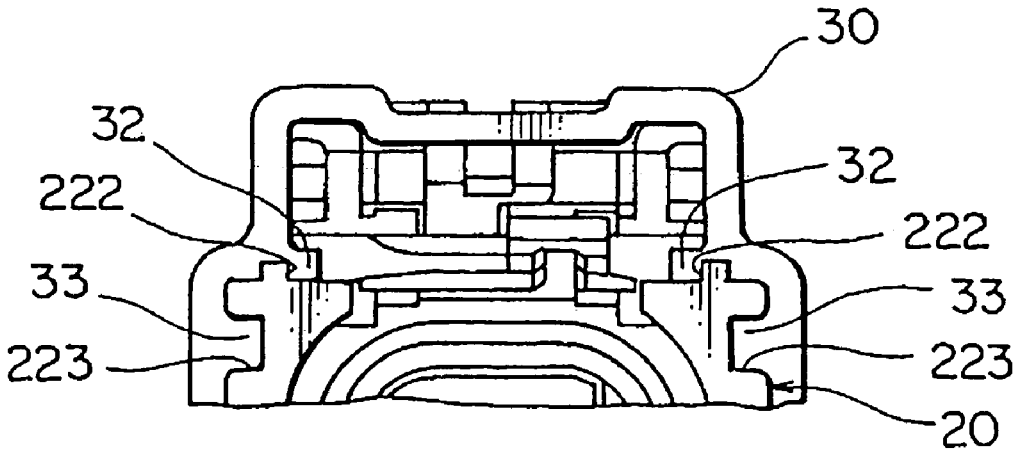
Figure 9:
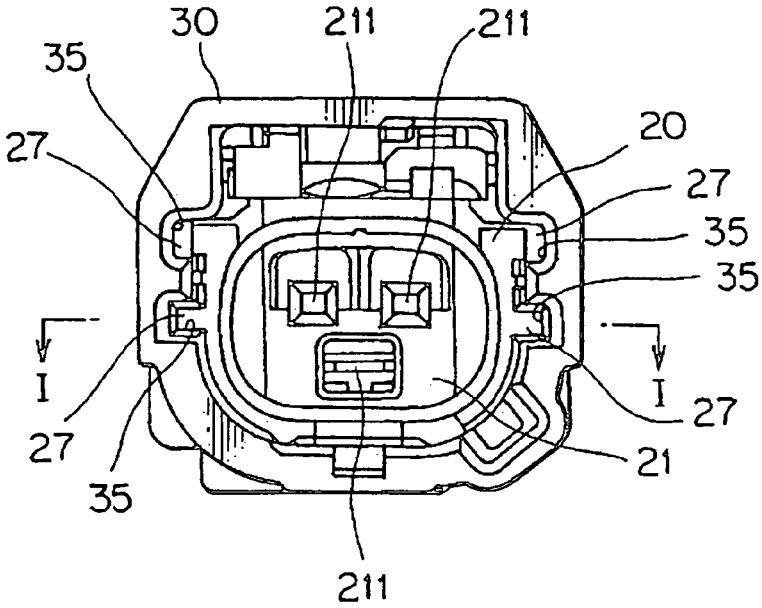
FIG. 9 PRIOR ART
FIG. 9 is a front view showing a conventional connector.
Figure 10:
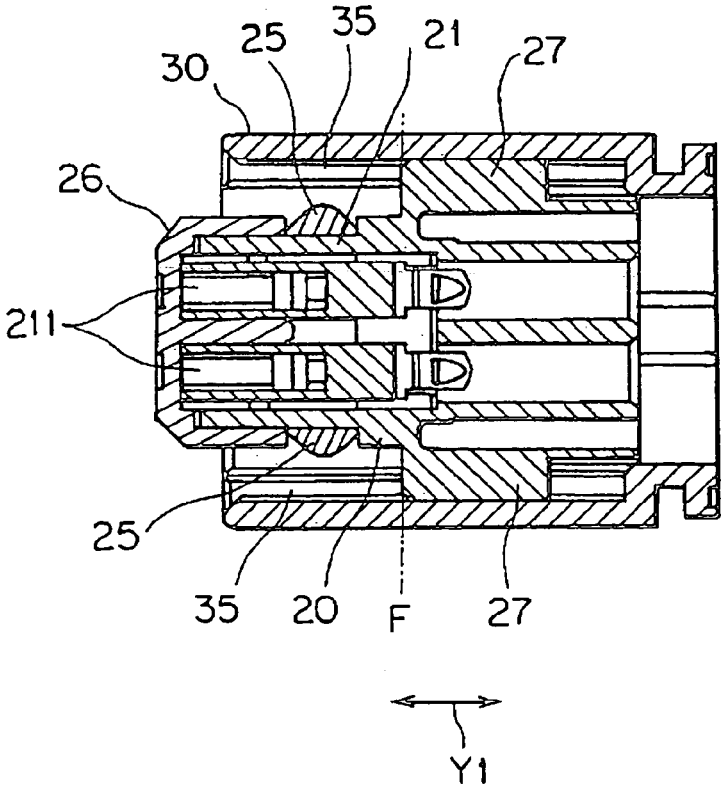
FIG. 10 PRIOR ART
FIG. 10 is a sectional view taken on line I-I of FIG. 9.

Further, in the embodiment described above, a pair of abutting walls 222 are formed on the position where the abutting walls face each other by providing a step on the female connector housing 20. However, this invention is not limited to this. For example, as shown in FIG. 8A, by providing grooves at the both sides of the notched groove 221 of the female connector housing 20, the pair of abutting walls 222 may be formed at the position where the abutting walls 222 face each other, and the deformation-preventing ribs 32 to be inserted into the groove may be formed on the inner sidewall of the half-fit detecting member 30. Further, for example, as shown in FIG. 8B, by forming projections at both sides of the notched groove 221 of the shroud 22, the pair of abutting walls 222 may be formed at the position where the abutting walls 222 face each other, and the deformation-preventing ribs 32 for abutting on the abutting wall may be formed on the inner sidewall of the half-fit detecting member 30.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector comprising: a connector housing including a housing main body having terminal receiving chambers for receiving terminals, and a tubular shroud on which a notched groove is formed in a length direction of the terminal, where a whole housing main body is received in the tubular shroud such that a rear end of the housing main body is connected to a rear end wall of the shroud; and a half-fit detecting member receiving the tubular shroud and the connector housing, the half-fit detecting member having a deformation-preventing member abutting on the shroud for preventing the notched groove from being deformed in a direction of reducing a groove width thereof;

wherein a pair of abutting walls facing each other is formed on both sides of the notched groove, and the deformation-preventing member is a pair of abutting pieces respectively abutting on the pair of abutting walls;

wherein a fitting groove is formed on one of an outer sidewall of the shroud and an inner sidewall of the half-fit detecting member, and a fitting projection for fitting to the fitting groove is formed on the other of said half-fit detecting member and shroud; and wherein each of the abutting walls is positioned in between the fitting projection and the abutting piece.

2. The connector as claimed in claim 1, wherein tapers are formed at rear ends of the pair of abutting walls in the length direction.

3. The connector as claimed in claim 1, wherein a locking member is mounted on each of the shroud and a connector cover in the length direction to lock said shroud and connector cover together.

4. The connector as claimed in claim 1, wherein the shroud receives the housing main body, and the front end of the shroud is arranged at a forward side of a top end of the housing main body.

* * * * *